US010643778B1

(12) United States Patent
Folker et al.

(10) Patent No.: US 10,643,778 B1
(45) Date of Patent: May 5, 2020

(54) MAGNETIC CORE STRUCTURE AND MANUFACTURING METHOD USING A GRINDING POST

(71) Applicant: Universal Lighting Technologies, Inc., Madison, AL (US)

(72) Inventors: Donald Folker, Madison, AL (US); Mike LeBlanc, Huntsville, AL (US)

(73) Assignee: Universal Lighting Technologies, Inc., Madison, AL (US)

( * ) Notice: Subject to any disclaimer, the term of this patent is extended or adjusted under 35 U.S.C. 154(b) by 275 days.

(21) Appl. No.: 15/898,518

(22) Filed: Feb. 17, 2018

Related U.S. Application Data

(62) Division of application No. 14/843,621, filed on Sep. 2, 2015, now abandoned.

(60) Provisional application No. 62/047,800, filed on Sep. 9, 2014.

(51) Int. Cl.

| | |
|---|---|
| ***H01F 27/255*** | (2006.01) |
| ***H01F 41/02*** | (2006.01) |
| ***H01F 27/26*** | (2006.01) |
| *H01F 3/08* | (2006.01) |

(52) U.S. Cl.
CPC ..... *H01F 27/255* (2013.01); *H01F 27/266* (2013.01); *H01F 41/0246* (2013.01); *H01F 3/08* (2013.01); *Y10T 29/49073* (2015.01)

(58) Field of Classification Search
CPC . H01F 3/08; H01F 3/14; H01F 27/255; H01F 27/26; H01F 27/266; H01F 27/306; H01F 27/325; H01F 41/0246; H01F 41/0266; Y10T 29/4902; Y10T 29/49073; Y10T 29/49075
See application file for complete search history.

(56) References Cited

U.S. PATENT DOCUMENTS

| | | | |
|---|---|---|---|
| 4,240,057 | A | 12/1980 | Decher et al. |
| 4,734,253 | A | 3/1988 | Sato et al. |
| 5,345,209 | A | 9/1994 | Saitoh et al. |
| 5,382,937 | A | 1/1995 | Saitoh et al. |
| 5,487,773 | A | 1/1996 | Seyama et al. |
| 5,683,617 | A | 11/1997 | Inuzuka et al. |
| 6,733,703 | B2 | 5/2004 | Billiet et al. |

(Continued)

OTHER PUBLICATIONS

"Soft Ferrites, A User's Guide," MMPA SFG-98, Magnetic Materials Producers Association, 8 South Michigan Avenue, Suite 1000, Chicago, Illinois 60603, 1998, pp. 1-44.

*Primary Examiner* — Peter Dungba Vo
*Assistant Examiner* — Joshua D Anderson
(74) *Attorney, Agent, or Firm* — Patterson Intellectual Property Law, P.C.; Gary L. Montle; Jerry Turner Sewell

(57) ABSTRACT

A magnetic assembly includes a bobbin with two end flanges. A passageway extends longitudinally between the end flanges. An inner core extends through the passageway. The inner core has first and second end surfaces, each end surface proximate to one of the end flanges. A rectangular outer core is positioned around the bobbin with inner surfaces of the outer core close to the outer surfaces of the end flanges of the bobbin. A respective gap is formed between each end surface of the inner core and the adjacent inner surface of the outer core. A protrusion is formed on at least one inner surface of the outer core to control the cavity distance between the inner surfaces of the outer core proximate to the end surfaces of the inner core. The thickness of the protrusion is selectably reduced to increase the cavity distance to control the gaps.

5 Claims, 12 Drawing Sheets

(56) References Cited

U.S. PATENT DOCUMENTS

| | | | |
|---|---|---|---|
| 6,933,827 | B2 | 8/2005 | Takeuchi et al. |
| 7,057,486 | B2 | 6/2006 | Kiko |
| 8,366,978 | B2 | 2/2013 | Koebel et al. |
| 8,401,690 | B2 | 3/2013 | Gleditzsch et al. |
| 8,449,811 | B2 | 5/2013 | Kretzschmar et al. |
| 2003/0184423 | A1 | 10/2003 | Holdahl et al. |
| 2015/0270051 | A1 | 9/2015 | Grubl et al. |

MAGNETIC CORE STRUCTURE AND MANUFACTURING METHOD USING A GRINDING POST

CROSS-REFERENCES TO RELATED APPLICATIONS

This application is a divisional application of U.S. patent application Ser. No. 14/843,621 filed Sep. 2, 2015, entitled "Magnetic Core Structure and Manufacturing Method Using a Grinding Post," which claims the benefit under 35 U.S.C. 119(e) of U.S. Provisional Patent Application No. 62/047,800 filed Sep. 9, 2014, entitled "Magnetic Core Structure and Manufacturing Method Using a Grinding Post." Both applications are incorporated by reference in their entireties herein.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

A magnetic assembly may include a bobbin having one or more windings wound around a central passageway through the bobbin. An inner core is positioned in the central passageway with first and second facing surfaces exposed at or near the two ends of the central passageway. The inner core has an inner core length between the two facing surfaces. An outer core has continuous outer walls that define an inner cavity. The outer core is positioned on the bobbin with the outer walls surrounding the bobbin and with first and second inner surfaces of the inner cavity juxtaposed with the first and second facing surfaces, respectively of the inner core. The outer core has a cavity length between the two inner surfaces. The inner core length and the cavity length are selected such that the cavity length is greater than the inner core length. A first gap is formed between the first facing surface of the inner core and the first inner surface of the inner cavity. A second gap is formed between the second facing surface of the inner core and the second inner surface of the inner cavity. The two gaps have a total gap width equal to the difference between the cavity length and the inner core length. To control the magnetic characteristics of magnetic assembly, it is desirable to control the widths of the two gaps.

The inner core and the outer core may be manufactured from a ceramic ferrite material based on iron-oxide, such as, for example, Mn—Zn ferrite, Ni—ZN ferrite or Mg—Zn ferrite. The ferrite material is formed into a desired size and shape by injection molding. One part of the forming process includes a sintering step at a high temperature (e.g., 1,280-1,380 C for a few hours). During the sintering process, the ferrite material may shrink up to 15 percent in any linear dimension, which may result in a loss of up to approximately 50 percent of the original volume of the original molded size and shape. Accordingly, the inner core and outer core are molded initially with sizes and shapes that are greater than a desired nominal shape to allow for the maximum expected shrinkage during the sintering process. If less than the maximum expected shrinkage of the inner core occurs, the inner core can be ground to the required inner core length. If less than the maximum shrinkage of the outer core occurs, the cavity length will be too short, and one or both of the inner surfaces of the cavity must be ground to provide the desired cavity length. The inner surfaces of the cavity are large compared to the size of each end of the inner core, and excessive grinding may be required to produce the desired cavity length.

BRIEF SUMMARY OF THE INVENTION

An aspect of the present invention is a magnetic assembly including a bobbin having a first end flange and a second end flange. The bobbin has a passageway between the first end flange and the second end flange. The passageway has a passageway length from the first end flange to the second end flange. The magnetic assembly further includes a magnetic core assembly having an inner core and an outer core. The inner core is positioned within the passageway of the bobbin. The inner core has an inner core length from a first end surface to a second end surface. The outer core includes a sintered ferrite material. The outer core has outer surfaces defining an outer wall. The outer wall surrounds a cavity having a first inner surface, a second inner surface, a third inner surface and a fourth inner surface. The first inner surface and the second inner surface are parallel to each other and are spaced apart by an overall cavity length. The first inner surface has at least a first protrusion that extends into the cavity toward the second inner surface. The first protrusion has a first protrusion face. The first protrusion face is spaced apart from a portion of the second inner surface by a modifiable cavity length. The outer core is positioned around the bobbin with the first protrusion face proximate to the first end surface of the inner core and with the portion of a second inner surface of the cavity proximate to the second end surface of the inner core. The first protrusion has a first protrusion length modifiable to adjust the modifiable cavity length to be longer than the inner core length by a total gap distance, wherein the total gap distance is a sum of a first gap distance and a second gap distance. The first gap distance is a distance between the first protrusion face and the first inner core face. The second gap is a distance between the portion of the second face of the inner wall and the second inner core face. In certain embodiments, the first gap distance is substantially equal to the second gap distance.

In certain embodiments of the magnetic assembly, the portion of the second inner surface of the cavity includes a second protrusion extending into the cavity toward the first protrusion. The second protrusion has a second protrusion face, which is spaced apart from the first protrusion face by the modifiable cavity length. The second protrusion has a second protrusion length modifiable to further adjust the modifiable cavity length.

In certain embodiments, the outer core is sintered from a molded outer core. Before the outer core is sintered, the first protrusion extends from the first inner surface by a pre-sintered grinding post length, which is selected to be at least as long as the product of an expected sintering shrinkage factor F times a sum of the inner core length and the total gap distance. The expected sintering shrinkage factor F is determined by a maximum expected sintering shrinkage percentage S, wherein F=S/(100−S).

Another aspect of the present invention is a method for assembling a magnetic assembly, which includes providing a bobbin having a first end flange and a second end flange. The bobbin has a passageway between the first end flange and the second end flange. The passageway has a passageway length from the first end flange to the second end flange. The method further includes inserting an inner core into the passageway of the bobbin. The inner core has a length such that a first end surface of the inner core is proximate to the first end flange of the bobbin and such that a second end face of the inner core is proximate to the second end flange of the bobbin. The inner core has an inner core length from the first end face to the second end face. The method further includes forming an outer core using a sintering process. The outer core has an outer wall surrounding an inner cavity. The inner cavity has at least a first inner surface and a second inner surface. The second inner surface is parallel to the first inner surface. At least the first inner surface has a first protrusion extending into the inner cavity toward the second inner surface. The first protrusion has a first protrusion face. The first protrusion face is initially spaced apart from a portion of the second inner surface by an initial modifiable inner cavity distance. The initial modifiable inner cavity distance is not controllable during the sintering process. The method further includes removing a portion of the first protrusion at the first protrusion face to increase the initial modifiable inner cavity distance to a modified inner cavity distance selected to be greater than the inner core length by a total gap distance. The method further includes positioning the outer core onto the bobbin with the first protrusion face proximate to the first end face of the inner core and with the portion of the second inner surface proximate to the second end face of the inner core.

In accordance with one aspect of the method, the first protrusion face is spaced apart from the first end face of the inner core by a first gap distance and the portion of the second inner surface is spaced apart from the second end face of the inner core by a second gap distance, wherein the second gap distance and the first gap distance being substantially equal.

In certain embodiments of the method, the portion of the second inner surface of the cavity further includes a second protrusion extending into the cavity toward the first protrusion face. The second protrusion has a second protrusion face. The method further includes removing a portion of the second protrusion at the second protrusion face to increase the modifiable inner cavity distance. In accordance with this embodiment of the method, the first protrusion face is spaced apart from the first end face of the inner core by a first gap distance and the second protrusion face is spaced apart from the second end face of the inner core by a second gap distance, wherein the second gap distance and the first gap distance are substantially equal.

In certain embodiments of the method, the outer core is formed by a sintering process. The first protrusion extends from the first inner surface by a pre-sintering grinding post length, which is selected to be at least as long as the product of an expected sintering shrinkage factor F times a sum of the inner core length and the total gap distance. The expected sintering shrinkage factor F is determined by a maximum expected sintering shrinkage percentage S during the sintering process, wherein F=S/(100−S).

Another aspect of the present invention is a method of producing a sintered outer core for a magnetic assembly. The method includes molding a ferrite material into a molded outer core having an outer wall around an inner cavity. The inner cavity has a first inner surface. A second inner surface is parallel to the first inner surface and is spaced apart from the first inner surface by an overall cavity length. A third inner surface is perpendicular to the first inner surface, and a fourth inner surface is parallel to the third inner surface. At least the first inner surface has a first protrusion extending into the cavity toward the second inner surface. The protrusion has a first protrusion face. The first protrusion face is spaced apart from a portion of the second inner surface by an initial modifiable cavity length. The protrusion has a length selected such that the initial modifiable length is no greater than a desired final modifiable cavity length and such that the protrusion length is greater than a selected percentage of the desired final modifiable cavity length. The method further includes sintering the molded outer core to form a sintered outer core. The sintered outer core has a sintered modifiable cavity length between the first protrusion face and the portion of the second inner surface. The method further includes selectively grinding the first protrusion face to shorten the first protrusion by an amount to increase the sintered modifiable cavity length to the final modifiable cavity length.

In certain embodiments of the method, the first protrusion extends from the first inner surface by a pre-sintered grinding post length, which is selected to be at least as long as the product of an expected sintering shrinkage factor F times a sum of the inner core length and the total gap distance. The expected sintering shrinkage factor F is determined by a maximum expected sintering shrinkage percentage S during sintering, wherein F=S/(100−S).

DETAILED DESCRIPTION OF THE INVENTION

In the following description, various dimensional and orientation words, such as height, width, length, longitudinal, horizontal, vertical, up, down, left, right, tall, low profile, and the like, may be used with respect to the illustrated drawings. Such words are used for ease of description with respect to the particular drawings and are not intended to limit the described embodiments to the orientations shown. It should be understood that the illustrated embodiments can be oriented at various angles and that the dimensional and orientation words should be considered relative to an implied base plane that would rotate with the embodiment to a revised selected orientation.

Figure 1:
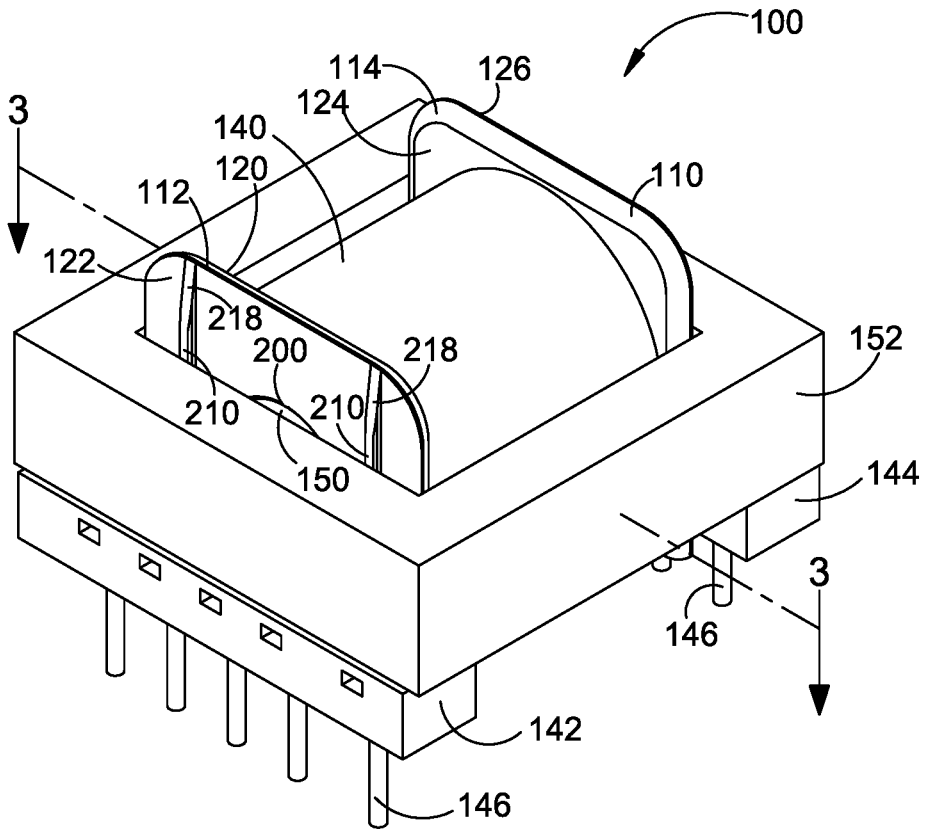
FIG. 1 illustrates a perspective view of a magnetic assembly having a bobbin, an inner core and a rectangular outer core.
Figure 2:
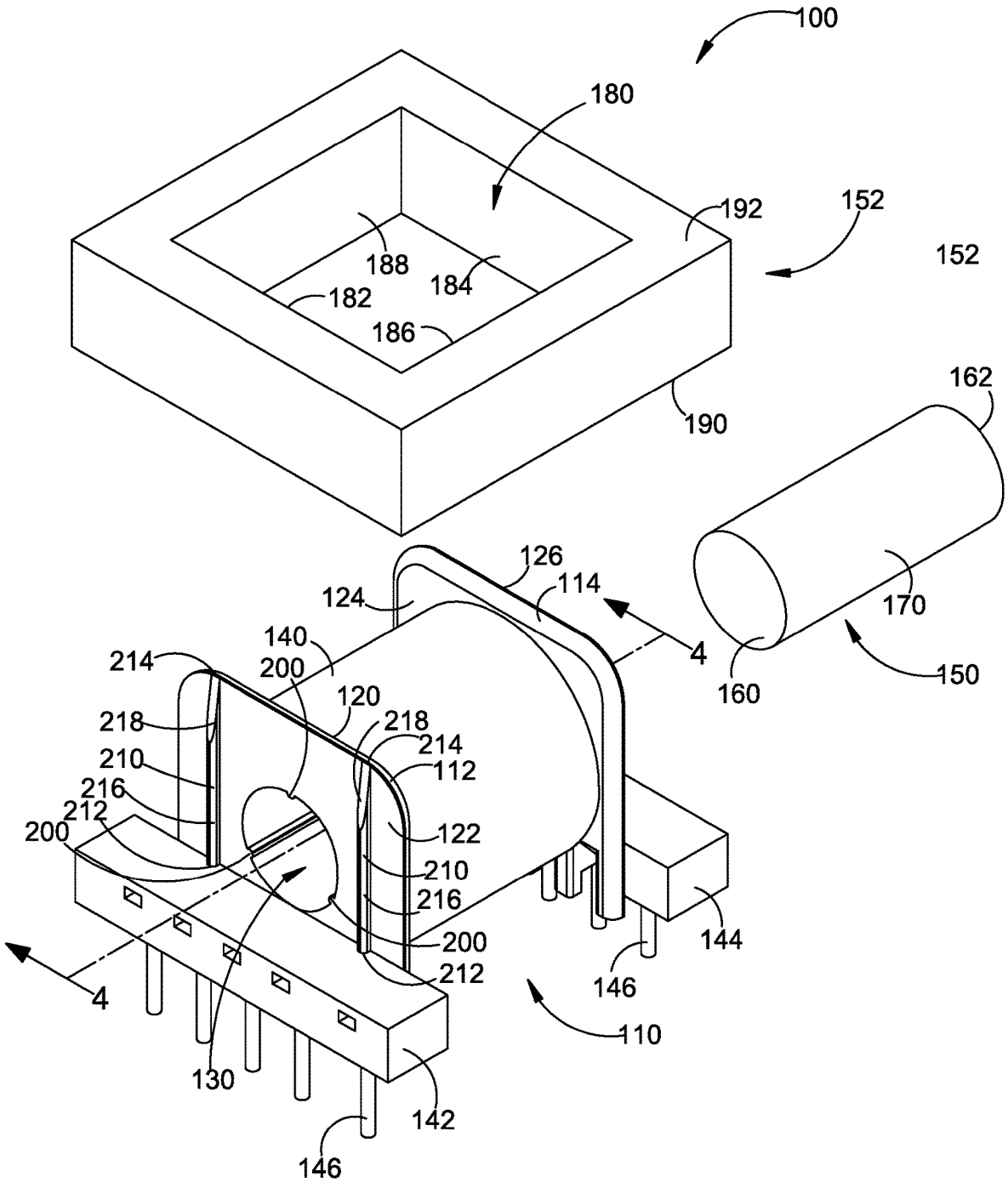
FIG. 2 illustrates an exploded perspective view of the assembly of FIG. 1.
Figure 3:
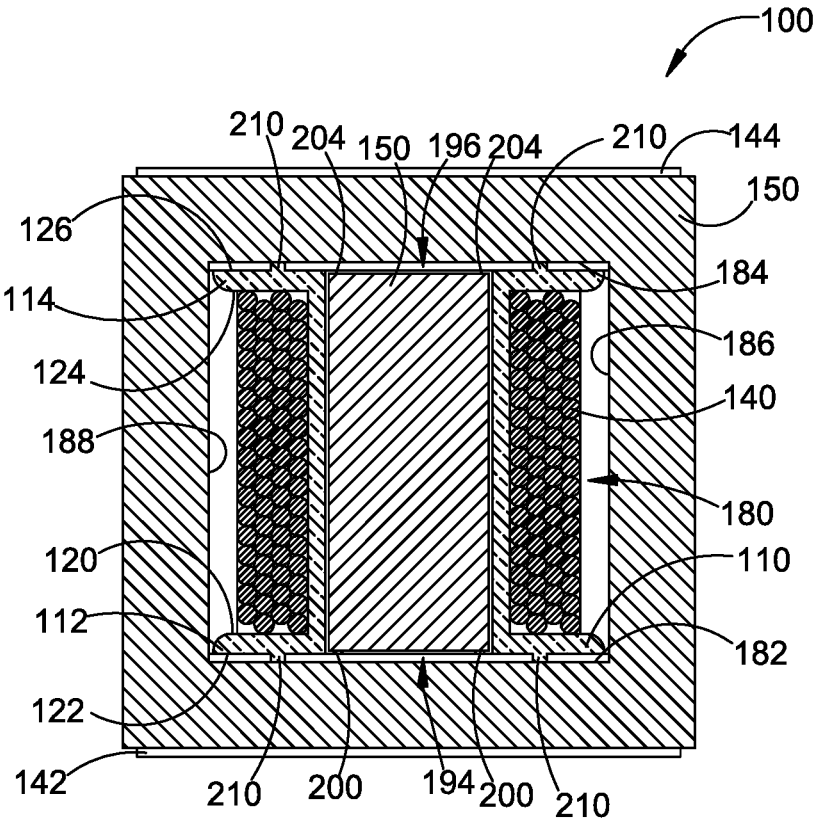
FIG. 3 illustrates a cross-sectional upper plan view of the assembly of FIG. 1 taken along line 3-3 in FIG. 1.
Figure 4:
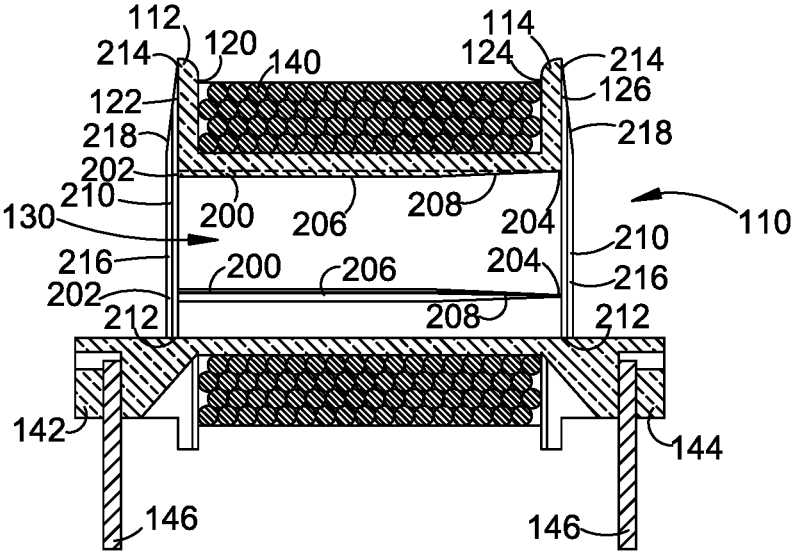
FIG. 4 illustrates cross-sectional elevational view of the bobbin of FIG. 2 taken along the line 4-4 in FIG. 2.
Figure 5:
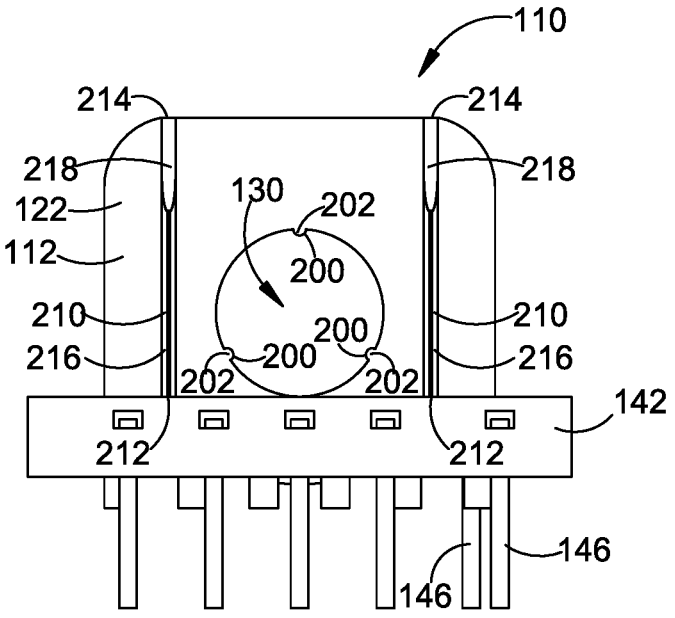
FIG. 5 illustrates a front elevational view of the bobbin of FIG. 2 before inserting the inner core into the passageway.
Figure 6:
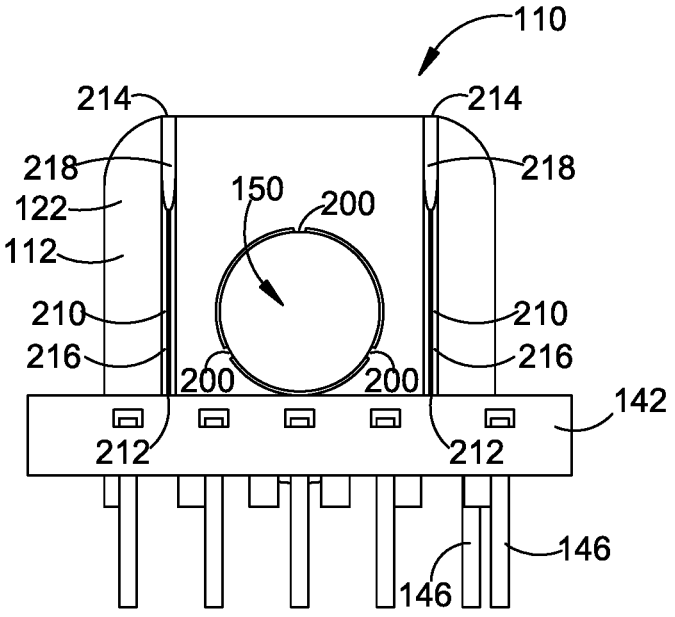
FIG. 6 illustrates the front elevational view of the bobbin of FIG. 5 after inserting the inner core into the passageway and before installing the outer core around the bobbin.

FIG. 1 illustrates a perspective view of a magnetic assembly 100 having an inner core with a circular cross section and a rectangular outer core. FIG. 2 illustrates an exploded perspective view of the magnetic assembly of FIG. 1. FIG. 3 illustrates a cross-sectional upper plan view of the assembly of FIG. 1 taken along the lines 3-3 in FIG. 1. FIG. 4 illustrates a cross-sectional elevational view of the bobbin taken along the lines 4-4 in FIG. 2. FIG. 5 illustrates a front elevational view of the front of the bobbin of FIG. 2 before inserting the central core. FIG. 6 illustrates the front elevational view of FIG. 5 after inserting the central core but before adding the outer core.

The magnetic assembly 100 of FIGS. 1-6 includes a bobbin 110 having a first end flange 112 and a second end flange 114. In the illustrated embodiment, the bobbin may be formed of nylon, such as, for example, commercially available Nylon 6/6 (also known as Nylon 66, Nylon 6-6 or Nylon 6,6). The first end flange 112 has an inner surface 120 and an outer surface 122. The second end flange 114 has an inner surface 124 and an outer surface 126. A longitudinal passageway 130 (FIG. 2) extends from the outer surface 122 of the first end flange 112 to the outer surface 126 of the second end flange 114. The passageway 130 has a cross-sectional profile. In the illustrated assembly, the profile is generally circular such the entire profile is arcuate.

The bobbin 110 further includes a winding 140, wherein the turns of the winding 140 are circular. Only the protective outer covering of the winding 140 is shown in FIGS. 1 and 2. The first end flange 112 is supported by a first base platform 142. The second end flange 114 is supported by a second base platform 144. The first and second base platforms include a plurality of contact pins 146 that are useable to mount the magnetic assembly to a circuit board (not shown). Some or all of the contact pins 146 are electrically connected to the winding 140 to provide electrical communication from the winding 140 to a circuit board.

As illustrated in in FIGS. 1-6, the magnetic assembly 100 includes a cylindrical inner core 150 and a generally rectangular outer core 152.

The inner core 150 has a longitudinal length between a first end surface 160 and a second end surface 162 that is less than or equal to the longitudinal length of the passageway 130. When the inner core 150 is centered within the passageway 130, the first end surface 160 is proximate to the first end flange 112, and the second end surface 162 is proximate to the second end flange 114. In embodiments where the longitudinal length of the inner core 150 is the same as the longitudinal length of the passageway 130, the first and second end surfaces of the inner core 150 may be flush with the outer surface 122 of the first end flange 112 and the outer surface 126 of the second end flange 114. In other embodiments where the longitudinal length of the inner core 150 is less than the longitudinal length of the passageway, the first and second end surfaces may be recessed by a small amount from the respective outer surfaces of the flanges.

In the illustrated embodiment, the inner core 150 is cylindrical and has a circular profile defined by a cylindrical outer surface 170. The profile of the inner core 150 is selected to conform to the profile of the passageway 130. The diameter of the inner core 150 is selected to be slightly smaller than the diameter of the passageway 130 so that the inner core 150 fits barely within the passageway 130 when inserted from the outer surface of the second end flange 114.

In the illustrated embodiment, the outer core 152 is a rectangular parallelepiped with a hollow inner cavity 180 sized to receive the bobbin 110. The outer core 152 has a continuous wall of a ferromagnetic material (e.g., a sintered ferrite core of iron, manganese and zinc) that surrounds the hollow inner cavity. The hollow inner cavity of the outer core 152 is defined by a first inner surface 182 and a parallel second inner surface 184. The first and second inner surfaces are perpendicular to a third inner surface 186 and to a fourth inner surface 188. The third and fourth inner surfaces are spaced apart by a distance selected to be substantially equal to a width of each of the first end flange 112 and the second end flange 114 so that the outer core 152 is positionable on the bobbin 110 with the third and fourth inner surfaces abutted against the end flanges as shown in FIG. 1. The outer core further has a lower surface 190 and an upper surface 192.

The first inner surface 180 and the second inner surface 182 of the outer core 152 are spaced apart by a distance greater than the longitudinal length of the passageway 130. When the outer core 152 is positioned on the bobbin 110 as shown in FIG. 1 and is centered with respect to the longitudinal length of the passageway 130, the first inner surface 180 of the outer core 152 is spaced apart from the first end surface 160 of the inner core 150 by a first distance to form a first gap 194 (FIG. 3), and the second inner surface 182 of the outer core 152 is spaced apart from the second end surface 162 of the inner core by a second distance to form a second gap 196 (FIG. 3). Preferably, the first distance or gap 194 and the second distance or gap 196 are substantially equal.

In the illustrated embodiment, the cross-sectional profile of rectangular outer core 152 has a height between the lower surface 190 and the upper surface 192. The inner core 150 has a diameter that is approximately equal to the height of the outer core 152. As illustrated, the height of the outer core 152 is less than the height of the first end flange 112 and the second end flange 114. Thus, the tops of the end flanges extend above the upper surface of the outer core 152 such that the overall height of the magnetic assembly 100 is greater than the height of the rectangular outer core.

As further illustrated in FIGS. 1-6, the passageway 130 of the bobbin 110 includes a plurality of passageway ribs 200. In the illustrated embodiment, three passageway ribs are provided with a first rib positioned near the topmost surface of the passageway, with a second rib positioned approximately 120 degrees clockwise from the first (top) rib, and with a third rib positioned approximately 240 degrees clockwise from the first rib, such that the ribs are equally spaced around the inner circumference of the passageway. A different number of ribs 200 can be incorporated into the inner surface of the passageway 130, and the ribs can be spaced apart by different angular amounts.

As shown in the elevational front view of FIG. 5, each passageway rib 200 is configured as a generally semicircular protuberance with the base of the protuberance intersecting the inner surface of the passageway 130 and with the circular perimeter extending into the passageway. As shown in the elevational cross-sectional view of FIG. 4, each passageway rib 200 tapers from a first thickness and a first width at a first end 202 proximate to the first end flange 112 to a relatively small second thickness and a relatively small second width at a second end 204 near the second end flange 114. The passageway ribs 200 of this embodiment can have varying widths, heights, lengths, and shapes. Each passageway rib 200 can taper continuously from the first end of the rib the second end of the. However, in the illustrated embodiment of FIGS. 1-6, each passageway rib 200 has an initial portion 206 (FIG. 4) proximate to the first end of the rib and has a second portion 208 proximate to the second end of the rib. The initial portion 206 is untapered, and the second portion 208 is tapered. For example, the untapered initial portion 206 may comprise about ⅔ of the length of the rib 200 and the tapered second portion 208 may comprise approximately ⅓ of the length of the rib.

The inner core 150 is positioned in the passageway 130 by inserting the first end surface 160 of the inner core 150 into the passageway 130 at the outer surface 126 of the second end flange 114. Pressure is applied to the second end surface 162 of the inner core 150 to force the first end surface 160 of the inner core 150 and the cylindrical body 170 into the passageway 130. As the first end surface 160 of the inner core 150 is pressed into the passageway 130, the inner core 150 initially rides upon the shorter portions of the passageway ribs 200 and then begins to crush the nylon ribs as the first end surface 160 of the inner core 150 is pressed further toward the outer surface 122 of the first end flange 112 of the bobbin 110 and encounters the portions of the passageway ribs 200 of increasingly greater height. In certain embodiments, the inner core 150 is positioned such that the end surfaces of the inner core 150 are positioned by approximately the same distance from the respective outer surfaces of the end flanges (e.g., either flush with the respective outer surfaces or recessed by approximately the same distance from the respective outer surfaces). After the inner core 150 is positioned in the passageway 130 and the pressure is removed from the second end, the resilience of the crushable nylon presses against the top and bottom surfaces of the inner core to securely retain the inner core in a fixed longitudinal position within the passageway.

As further illustrated in FIGS. 1-6, the bobbin 110 of the magnetic assembly 100 further includes a plurality of outer positioning ribs 210 on the outer surface 122 of the first end flange 112 and on the outer surface 126 of the second end flange 114. In the illustrated embodiment, each outer surface includes two outer positioning ribs 210 for a total of four positioning ribs. One outer positioning rib 210 is positioned on either side of the opening to the passageway 130 on each outer surface. Each outer positioning rib 210 extends from a first end 212 at the upper surface of the respective first base platform 142 or second place platform 144 and extends to a respective terminal end 214 near the top of the respective outer surface. Each outer positioning rib 210 tapers to an increasingly smaller size from the respective base end to the respective terminal end.

Each outer positioning rib 210 can taper continuously from the first (base) end 212 of the rib to the second (terminal) end 214 of the rib. In the illustrated embodiment of FIGS. 1-6, each outer positioning rib 210 has an initial portion 216 proximate to the first end of the rib and has a second portion 218 proximate to the terminal end of the rib. The initial portion 216 is untapered, and the second portion 218 is tapered. For example, the untapered initial portion 216 may comprise about ⅔ of the length of the rib 210 and the tapered second portion 218 may comprise approximately ⅓ of the length of the rib.

The four outer positioning ribs 210 position and secure the rectangular outer core 152 with respect to the bobbin 110 when the outer core is pushed down onto the ribs until the lower surface 190 of the outer core abuts the upper surfaces of the first base platform 142 and the second base platform 144. Accordingly, the gaps 194, 196 are substantially equal as shown in FIG. 3. No gluing, taping or other additional steps are required to complete the assembly process for the embodiment of FIGS. 1-6.

In the illustrated embodiment of FIGS. 1-6, the rectangular outer core 152 has a size and a shape configured such the first inner surface 182 and the second inner surface 184 of the cavity 180 are spaced apart by a selected cavity length. The selected cavity length is greater than the length of the inner core 150 by a total gap distance. Ideally, the outer core 152 and the inner core 150 are manufactured with close tolerances such that the required dimensional relationships are produced for each physical embodiment of a combination of an outer core and an inner core. However, in accordance with a manufacturing method disclosed herein, the outer core 152 and the inner core 150 are manufactured by molding a ferromagnetic composition to form the desired shapes and dimensions. For example, the ferromagnetic composition may be a ceramic ferrite material based on iron-oxide, such as Mn—Zn ferrite, Ni—ZN ferrite or Mg—Zn ferrite. The powdered ferrite material is formed into an initial size and shape by injection molding. The molded (green) body is degreased and is then heated during a sintering step at a high temperature (e.g., 1,280-1,380° C. for a few hours) to convert the discrete powder particles into a continuous, dense polycrystalline solid having a shape similar to the initial shape and having reduced linear dimensions. During the sintering process, the initial powdered ferrite material may shrink up to 15 percent in any linear dimension, which may result in a loss of up to approximately 50 percent of the original volume of the original molded size and shape.

Figure 7:
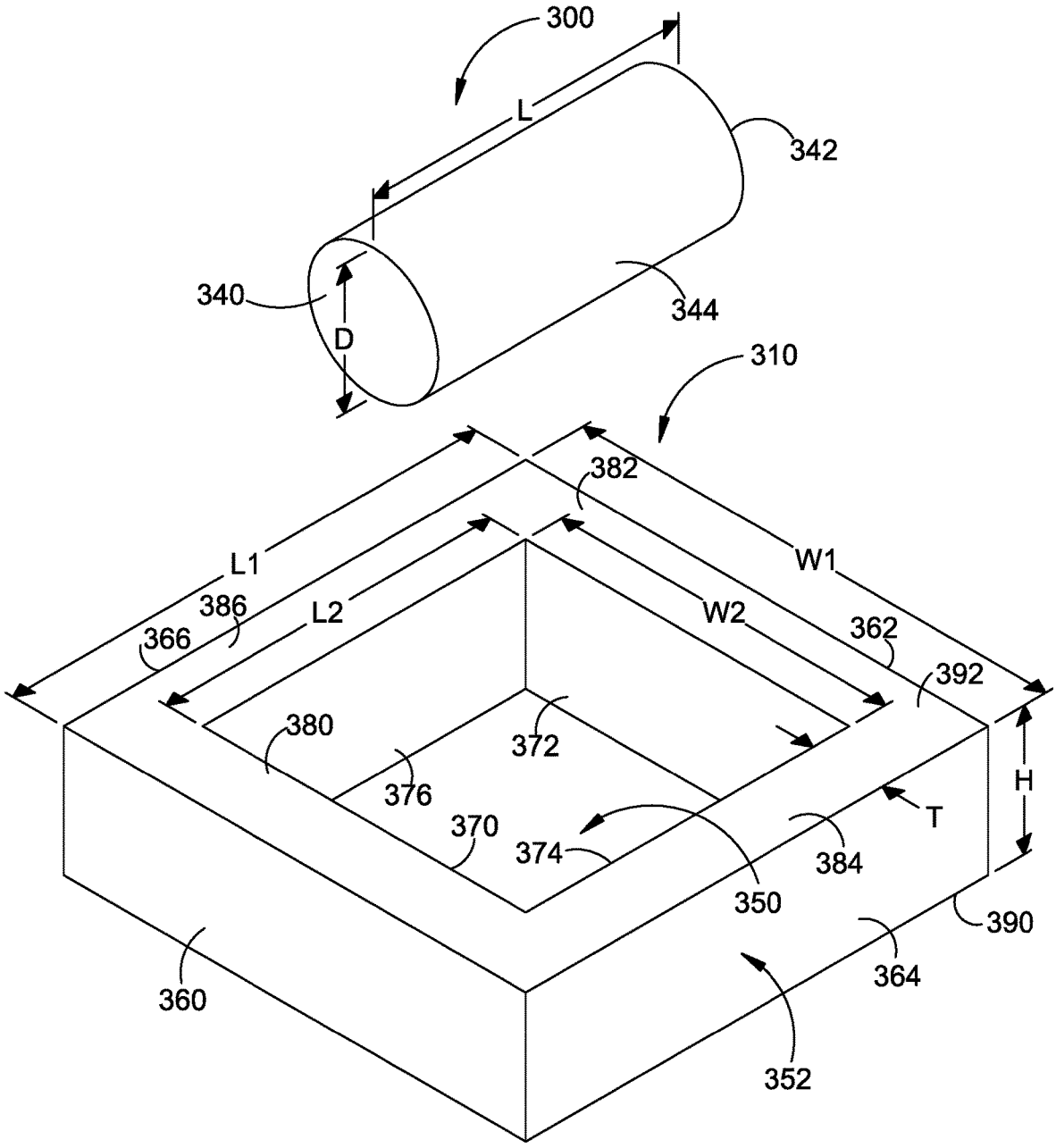
FIG. 7 illustrates an inner core body and an outer core body as formed by a molding process to show the dimensions of the two bodies prior to a sintering process.
Figure 8:
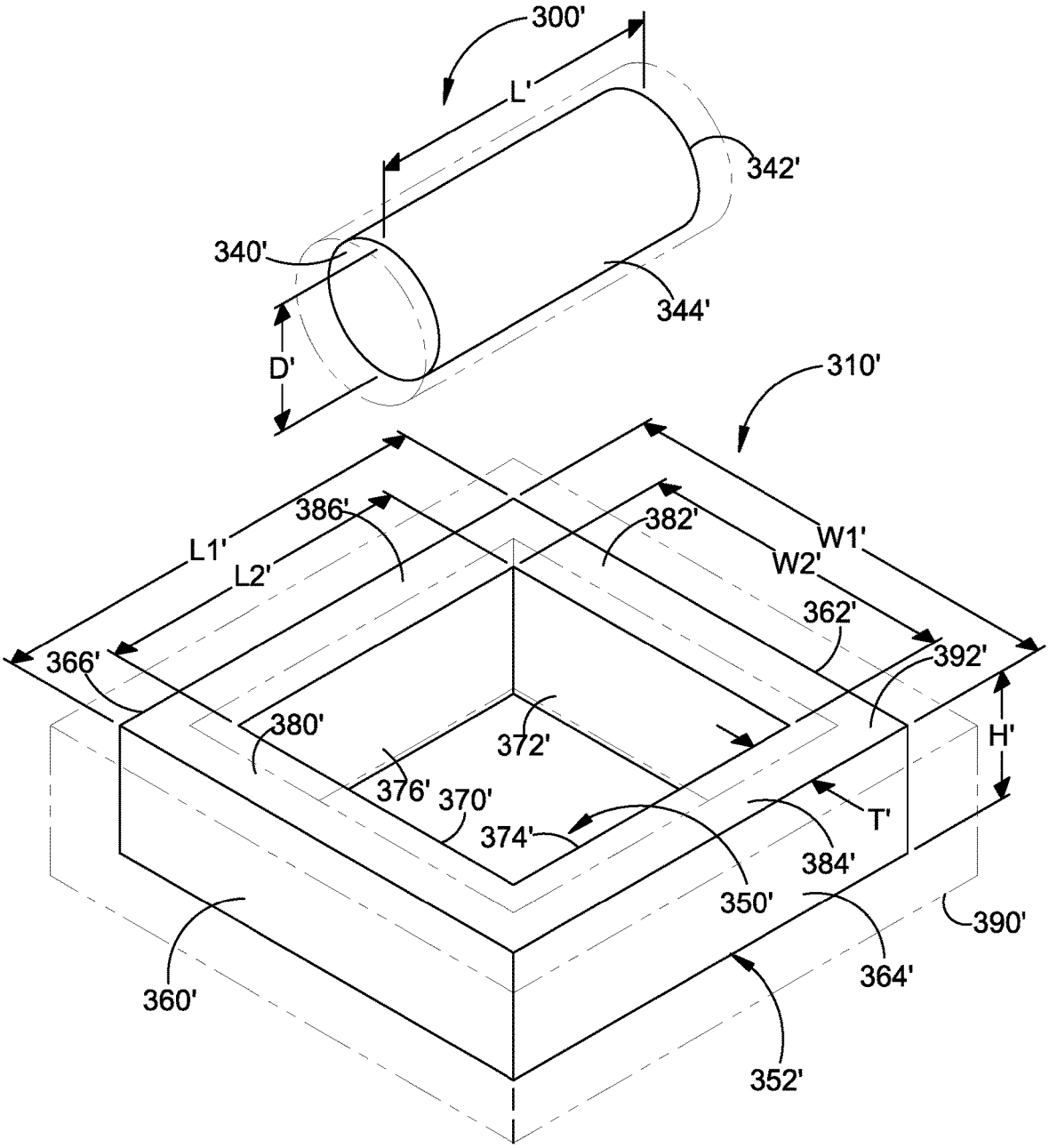
FIG. 8 illustrates the effect of a sintering process on the inner core body and the outer core body of FIG. 7, wherein the pre-sintering bodies of FIG. 7 are shown in phantom lines and the smaller post-sintering bodies are shown in solid lines.

The molding and sintering processes to form the inner core 150 and the outer core 152 of FIGS. 1-6 are illustrated in FIGS. 7-12. FIG. 7 illustrates an initial molded inner core body 300 and an initial molded outer core body 310. FIG. 8 illustrates a final sintered inner core body 300' and a final sintered outer core body 310'. The final sintered inner core body 300' corresponds to the inner core 150 of FIGS. 1-6. The final sintered outer core body 310' corresponds to the outer core 152 of FIGS. 1-6. The molded bodies prior to sintering are referred to herein as "green" bodies because the bodies do not have their respective final characteristics (e.g., sizes, shapes and ferromagnetic characteristics) until the bodies have undergone the sintering process.

In FIG. 7, the green inner core body 300 has a first end surface 340, a second end surface 342 and an outer surface 344. Each end surface is circular, and the outer surface is cylindrical. The green inner core body has an initial inner core length L between the first end surface and the second end surface. The inner core body has an initial inner core diameter D.

In FIG. 7, the green outer core body 310 is a rectangular parallelepiped with a hollow inner cavity 350. The outer core body 310 includes a continuous wall 352 that surrounds the hollow inner cavity. The wall 352 has a front outer surface 360, a rear outer surface 362, a first (right) side surface 364 and a second (left) side surface 366. The front outer surface 360 and the rear outer surface 362 define an outer width W1 of the outer core body 310. The first side surface 364 and the second side surface 366 define an outer length L1 of the outer core body.

The hollow inner cavity 350 of the outer core body 310 is defined by a first inner surface 370, a parallel second inner surface 372, a third inner surface 374 and a fourth inner surface 376. The first and second inner surfaces are perpendicular to the third fourth inner surfaces.

The wall 352 of the outer core body 310 includes: a front wall portion 380 between the first outer surface 360 and the first inner surface 370; a rear wall portion 382 between the second outer surface 362 and the second inner surface 372; a right side wall portion 384 between the third outer surface 364 and the third inner surface 374; and a left side wall portion 386 between the third outer surface 364 and the third inner surface 374. In the illustrated embodiment, each wall has a common wall thickness T; however, in other embodiments, the thicknesses may be different. For example, the respective thicknesses of the front and rear wall portions may differ from the thicknesses of the sidewall portions.

In the illustrated embodiment, the wall 352 has a uniform height H between a lower surface 390 and an upper surface 392.

The first inner surface 370 and the second inner surface 372 of the cavity 350 are spaced apart by a cavity length L2. The third inner surface 374 and the fourth inner surface 376 are spaced apart by a cavity width W2. The cavity length L2 is substantially equal to the outer length L1 minus a sum of the thicknesses of the two end walls (e.g., L2=L1−2T in the embodiment where the two end wall thicknesses are equal). The cavity width W2 is substantially equal to the outer width W1 minus a sum of the thicknesses of the two side walls (e.g., W2=W1−2T in the embodiment where the two side wall thicknesses are equal).

Assuming the green inner core body 300 and the green outer core body 310 could be manufactured repeatedly to precise dimensions, the desired gaps between the first and second end surfaces 340, 342 of the green inner core body and the first and second inner surfaces 370, 372 of the green outer core body can be established by dimensioning the cavity length L2 to be substantially equal to the sum of the inner core body length L and the total gap distance G (e.g., L2=L+G). However, the green inner core body 300 and the green outer core body 310 shown in FIG. 7 are not completed structures that can be used as the inner core 150 and the outer core 152 of FIGS. 1-6. The green bodies do not exhibit the requisite ferromagnetic characteristics until the green bodies are sintered to convert the green bodies into the final, continuous, dense polycrystalline solid as discussed above.

During the respective sintering processes, the green inner core body 300 of FIG. 7 densifies to a sintered inner core body 300', which is illustrated in FIG. 8. Similarly, the green outer core body 310 densifies to a sintered outer core body 310', which is also illustrated in FIG. 8. In FIG. 8, the sintered bodies are shown in solid lines and the larger green bodies are shown in phantom lines to illustrate the shrinkage that occurs during the sintering process. FIG. 8 illustrates the effect of approximately 15 percent shrinkage. Smaller percentages of shrinkage may also occur during the sintering process.

In the sintered inner core body 300' and the sintered outer core body 310' of FIG. 8, corresponding elements are numbered as before with a prime (') indicator after each number to designate the elements of the sintered bodies. Accordingly, the sintered inner core body 300' has a first end surface 340', a second end surface 342', and an outer surface 344'. Similarly, the sintered outer core body 310' has a hollow inner cavity 350', a continuous wall 352', a front outer surface 360', a rear outer surface 362', a first (right) side surface 364', a second (left) side surface 366', a first inner surface 370', a parallel second inner surface 372', a third inner surface 374', a fourth inner surface 376', a front wall portion 380', a rear wall portion 382', a right side wall portion 384', a left side wall portion 384', a lower surface 390', and an upper surface 392'.

The densifications of the two sintered bodies 300', 310' result in the shrinkage of the two sintered bodies such that the respective lengths, widths, heights and thicknesses are reduced. The reduced dimensions are identified in FIG. 8 with corresponding indicators followed by a prime indicator (i.e., L', D', L1', L2', W1', W2', T', and H'). As discussed above, the shrinkage of the original green bodies 300, 310 during the sintering process may cause the respective primed dimensions of the sintered bodies to be smaller than the corresponding original dimensions by as much as 15 percent of the original dimensions. The percent of shrinkage may not be uniform with respect to all the dimensions of the same body. The percent of shrinkage may also differ for the two bodies. Thus, the sintering process may result in the inner cavity length L2' of the sintered outer core body being too short with respect to the length L' of the sintered inner core body, which causes the total gap distance G to be too small. The sintering process may also result in the inner cavity length L2' of the sintered outer core body being too long with respect to the length L' of the sintered inner core body, which causes the total gap distance D to be too large. The sintering processes are not sufficiently controllable to assure that the gap distance is the same for each combination of a sintered outer core body and an inner core body.

Because of the expected shrinkage during the sintering process, the green inner core body 300 and the green outer core body 310 are produced with initial sizes and shapes that are greater than a desired nominal shape by a sufficient amount to allow for the shrinkage. For example, if the maximum expected shrinkage is known to be no more than 15 percent such that the sintered dimensions are at least 85 percent of the original dimensions, selecting the initial dimensions of the green (pre-sintered) bodies to be about 18 percent greater than the desired nominal dimensions results in the dimensions of the sintered bodies being at least as large as the desired nominal dimensions. As indicated above, the inner core body and the outer core body may incur differing percentages of shrinkage during the respective sintering processes. The inner core body may also be formed using different materials, formed using a different process, or formed using both different materials and a different process.

If less than the maximum expected shrinkage of the green (unsintered) inner core body 300 occurs during the sintering process such that the length L' of the sintered inner core body 300' is too large, one or both of the first end surface 340' or the second end surface 342' of the sintered inner core body can be ground to the desired inner core length. For the purposes of the following discussion, the desired length of the inner core body is assumed to be the sintered length L', and the dimensions of the outer core body 310 are adjusted to provide the desired gap distance G.

If less than the maximum shrinkage of the green (unsintered) outer core body 310 occurs during the sintering process, the overall cavity length L2' of the sintered outer core body 310' will be too short, which may require grinding of the first inner surface 370', grinding of the second inner surface 372', or grinding of both inner surfaces of the sintered cavity 350' to provide the desired cavity length L2' of L'+G. To grind at least one of the inner surfaces so that the resulting cavity length is equal to the desired cavity length, a substantial portion of the respective inner surface must be ground away to avoid fringing effects between the end surface of the inner core and the unground portions of the inner surface of the outer core. Such additional grinding is time consuming and may result in an uneven inner surface.

Figure 9:
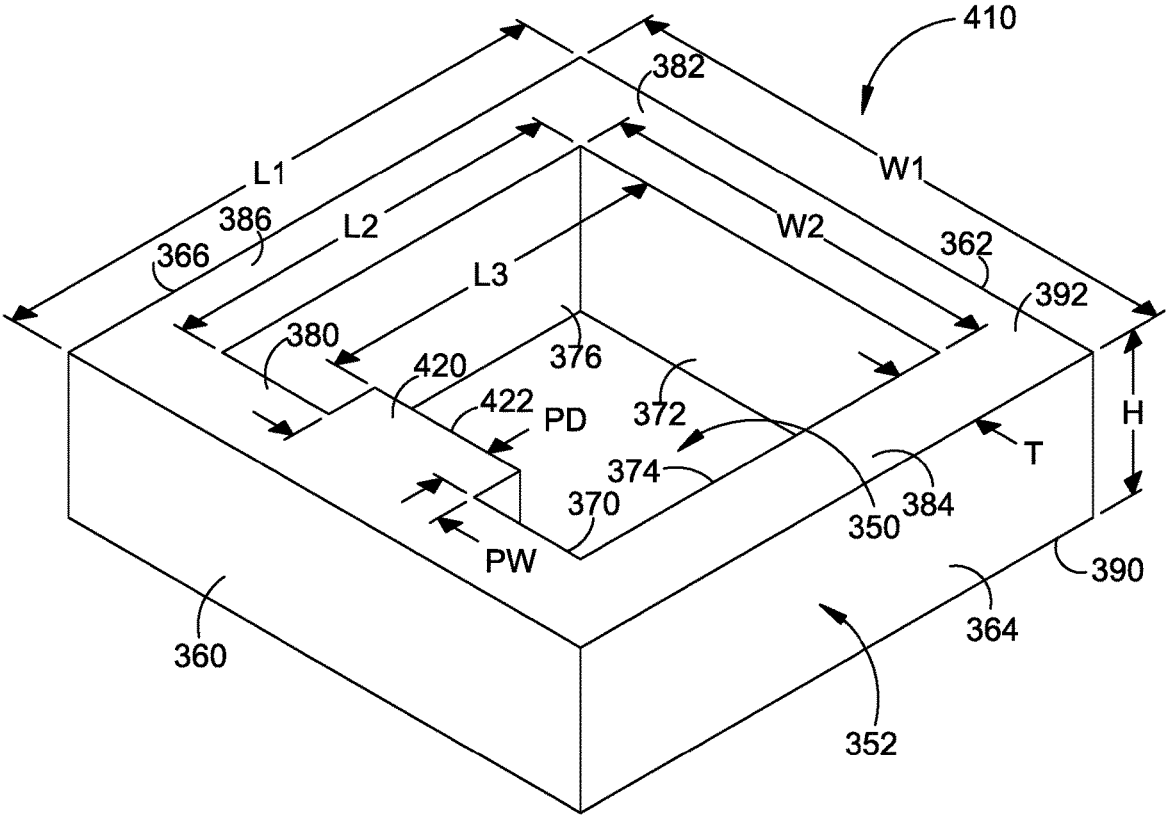
FIG. 9 illustrates an improved molded outer core body having a grinding post (protrusion) extending into the inner cavity of the outer core body.

FIG. 9 illustrates a perspective view of a green (pre-sintered) outer core body 410 that provides a solution to the foregoing problem caused by the variability in shrinkage of the outer core during the sintering process. The green outer core body 410 of FIG. 9 has the same general outer shape and the same general inner cavity shape as the previously described outer core body 310. Thus, like elements are identified with like numbers as in the previous embodiments. The outer core body of FIG. 9 includes at least one grinding post 420 that extends from the first inner surface 370 to a first grinding post face 422. The first grinding post face 422 is parallel to the first inner surface. In an alternative embodiment described below, a second grinding post is included.

As illustrated in FIG. 9, the grinding post 420 extends into the cavity 350 by a selected pre-sintering grinding post depth PD. The grinding post depth PD is selected in a manner discussed below. The grinding post extends from the lower surface 390 to the upper surface 392 of the outer core body and thus has a height H. The grinding post has a width PW along the first inner surface of the cavity. The grinding post is positioned substantially in the center of the respective inner surface so that the face of the grinding post is aligned with the first end face 340 of the inner core body 300 if the inner core body were to be positioned in the bobbin 110 (FIGS. 1-6) in place of the inner core 150 as described above. The grinding post causes the cavity to have a modified cavity length L3 from the face of the grinding post to the second inner surface 372 of the cavity. The modified cavity length L3 is determined by the difference between the overall cavity length and the grinding post depth (e.g., L3=L2−PD).

Figure 10:
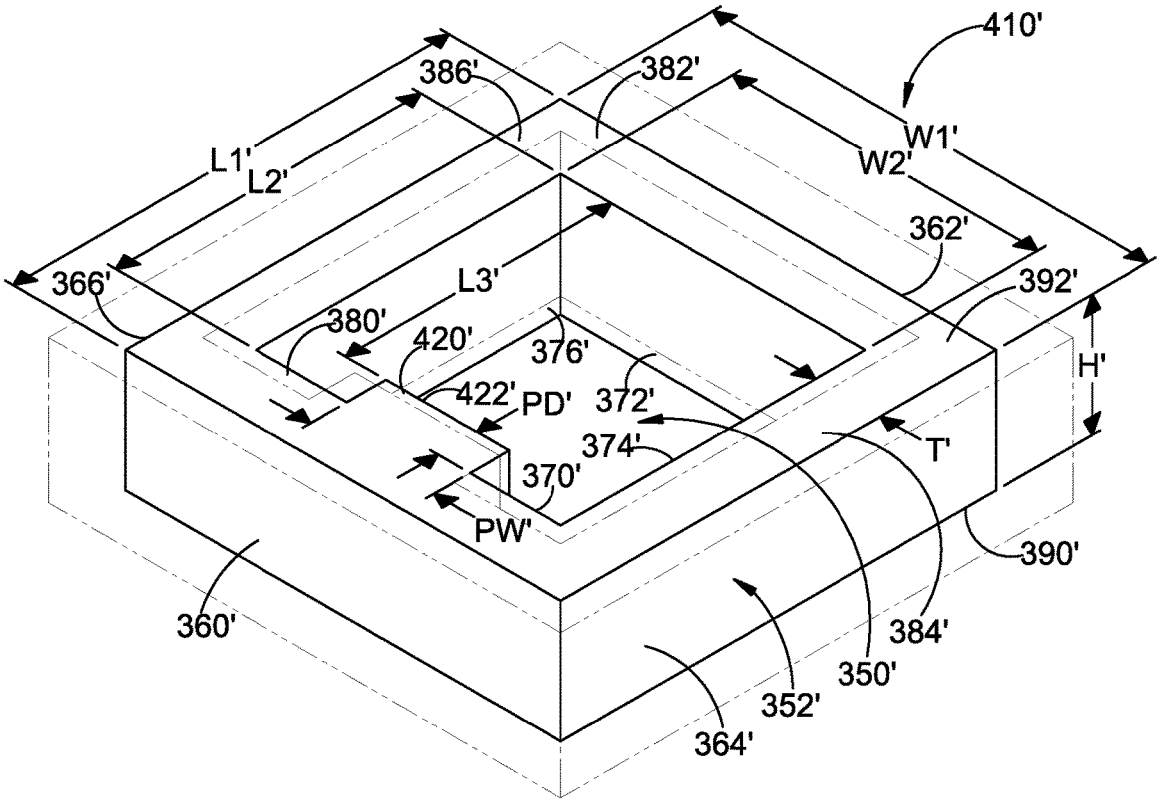
FIG. 10 illustrates the outer core body of FIG. 9 following the sintering process wherein the dimensions of the sintered outer core body are smaller than the corresponding dimensions of the unsintered body of FIG. 9, wherein the pre-sintering outer core body of FIG. 9 is shown in phantom lines and the smaller post-sintering outer core body is shown in solid lines.

When the pre-sintered outer core body 410 of FIG. 9 is sintered in the manner discussed above, the dimensions shrink to produce a sintered outer core body 410', which is illustrated in FIG. 10. The sintered outer core body of FIG. 10 is labeled in accordance with the sintered outer core body 310' of FIG. 8 with like elements have corresponding identifiers. The grinding post 420 of the pre-sintered outer core body also shrinks to produce a smaller sintered grinding post 420' with a respective sintered grinding post face 422'. The sintered grinding post 420' has a respective grinding post depth PD' from the first inner surface 370' of the cavity 350' to the grinding post face. The sintered grinding post has a grinding post width PW' and a height H'. The pre-sintered modified cavity length L3 also shrinks to a sintered modified cavity length L3' wherein L3'=L2'−PD'.

Figure 11:
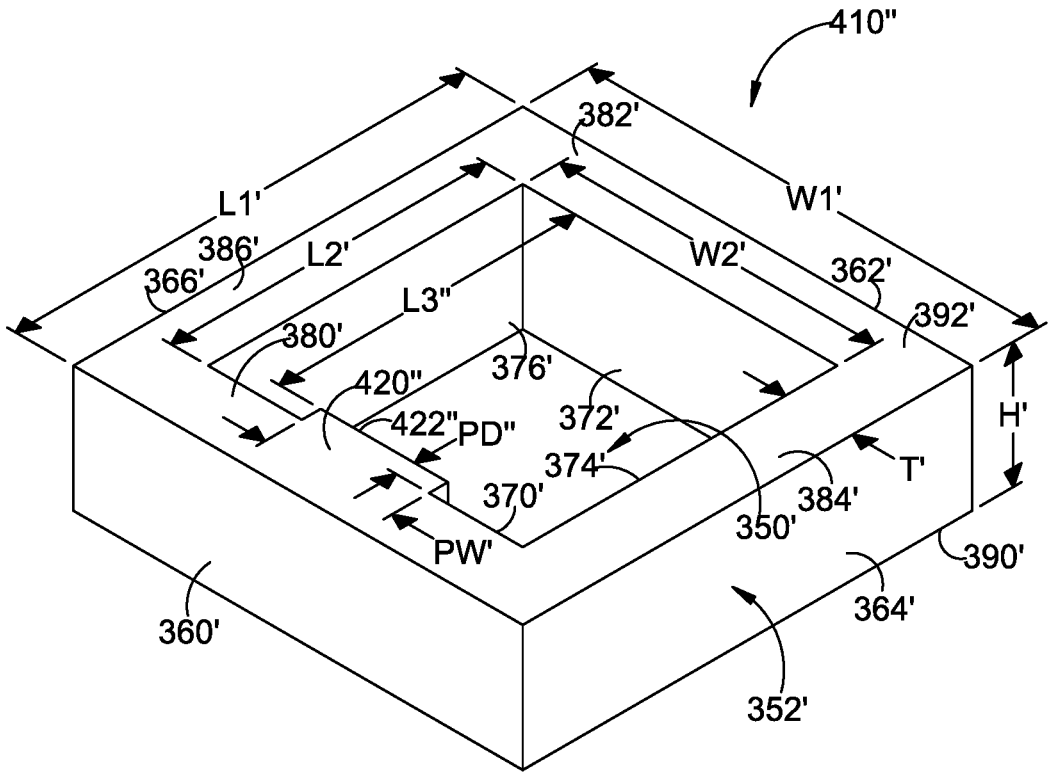
FIG. 11 illustrates the sintered outer core body of FIG. 10 wherein the depth of the grinding post is reduced to adjust the modified cavity length.

The original (pre-sintered) total grinding post depth PD of the grinding post 420 is selected such that the sintered modified (pre-grinding) cavity length L3' is adjustable by grinding the post-sintered grinding post 420' to reduce the sintered total grinding post depth PD' to a shortened total grinding post depth PD" shown in FIG. 11. The grinding process produces a final modified cavity length L3", wherein the final cavity length is equal to the sintered modified cavity length L3' reduced by the shortened grinding post length PD" (e.g., L2"=L3'−PD"). The final modified cavity length L3" is selected to produce the desired total gap distance G with respect to the first and second end surfaces 340', 342' of the sintered inner core body 300' (e.g., L3"=L'+G).

The pre-sintered total grinding post depth PD is selected in accordance with the following criteria. For the purpose of the following discussion, the length L' of the sintered inner core 300' is again assumed to be the desired nominal length for the inner core. The sintered inner core is either formed or adjusted (e.g., by grinding) so that the length L' is the same length for each combination of sintered inner core 300' and sintered outer core 410'.

The maximum pre-sintering modified cavity length L3 is first determined by assuming the unlikely, but still possible, event that the pre-sintered outer core body 410 incurs no shrinkage during the sintering process. Since the modified cavity length L3' cannot be shortened after the sintering process, the initial, pre-sintering, modified cavity length L3 can be no longer than the desired final modified cavity length L3", which is equal to L'+G, as discussed above. This relationship (L3=L'+G) is shown for the pre-sintering (green) outer core body 410 in the upper stage of the process of FIG. 12.

Figure 12:
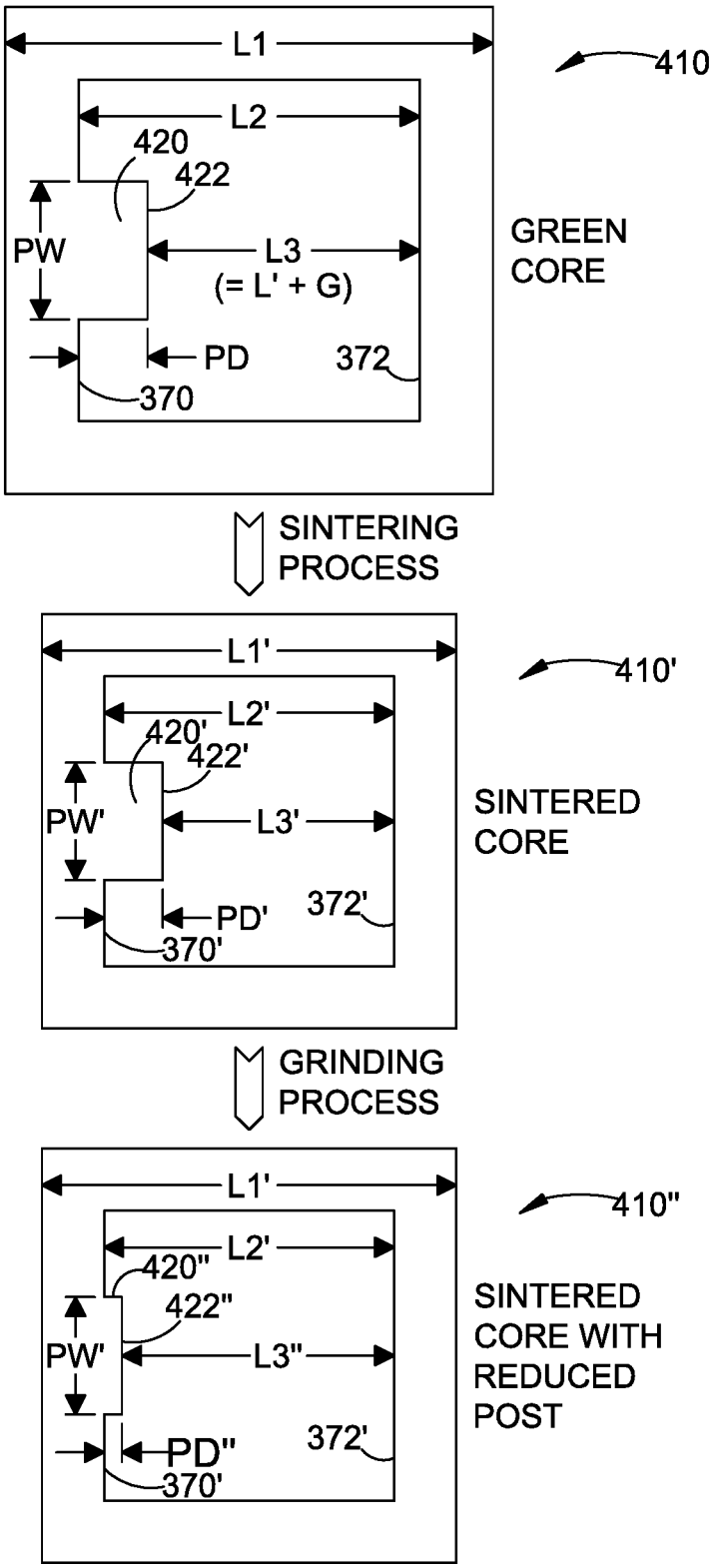
FIG. 12 illustrates the three stages in the production of the sintered and ground outer core body of FIG. 11, wherein the body in the upper stage is the molded (green) outer core body before sintering, the body in the middle stage is the sintered outer core body before grinding the protrusion, and the body in the lower stage is the sintered outer core body after grinding the protrusion.

As discussed above, the sintering process may result in up to 15 percent shrinkage in all dimensions, which is illustrated by the sintered outer core body 410' in the middle stage of the process of FIG. 12. In this stage, the sintered outer core body is assumed to have incurred the maximum shrinkage. Thus, the sintered modified cavity length L3' is assumed to have shrunk to 85 percent of the original unsintered modified cavity length L3 (e.g., L3'=0.85×L3). Because of the criteria for the possible case of no shrinkage, the original unsintered modified cavity length L3 was set above to be equal to the sum of the length L' of the sintered inner core body 300' and the gap distance G (e.g., L3=(L'+G)). Thus, the minimum length of the sintered modified cavity length L3' can be as short as 85 percent of L'+G (e.g., L3'=0.85×(L'+G)). In this illustrated example, the minimum length of L3' is insufficient to accommodate the sintered inner core body and provide the desired gap distance G.

To increase the sintered modified cavity length L3' to a sufficient length, a portion of the sintered grinding post 420' is removed by grinding the sintered grinding post 420' from the sintered grinding post depth PD' to the post-grinding grinding post depth PD" shown in the lower stage of the process of FIG. 12. To avoid grinding into the first inner surface 370' of the cavity 350', the sintered grinding post preferably has a pre-grinding sintered depth PD' of at least 15 percent of L'+G (e.g., PD'≥(0.15×(L'+G))). Since the sintered depth PD' of the grinding post may be only 85 percent of the original (green) grinding post depth PD, the original grinding post depth PD should be approximately 1.18 times the sintered grinding post depth PD' (e.g., PD=(1.18×PD') to allow for the maximum shrinkage (e.g., 85 percent of 1.18×PD'=PD). Since 1.18 times 0.15 is approximately equal to 0.176, the original grinding post depth PD should be approximately 0.176 times L'+G (e.g., PD=(0.176×(L'+G))). Selecting an original grinding post depth PD of approximately 0.18 times L'+G (e.g., PD=(0.18×(L'+G)) assures that at least a small portion of the grinding post remains after the grinding process even if the worst-case shrinkage of 15 percent occurs during the sintering process. Thus, the grinding process will not extend into the bulk portion of the first inner surface 370' of the cavity 350'.

The foregoing process for selecting the pre-sintering grinding post depth PD of the molded outer core body 310 can be represented by an equation:

$$PD=(L'+G)\times(S/(100-S))=(L'+G)\times F,$$

where F is a depth selection factor for PD, which is equal to S/(100−S) where S is the maximum percentage of shrinkage.

In the illustrated example of a maximum shrinkage S of 15 percent, F is approximately equal to 0.176. Accordingly, PD is calculated as:

$$PD=(L'+G)\times 0.176.$$

Thus, an initial depth PD of the grinding post 420 of about 0.18×(L'+G) would be adequate to assure that the post-sintering grinding post depth PD' is sufficient to allow the required post-sintering, post-grinding modified cavity length L3" to be produced.

In another example where the maximum expected shrinkage S is 5 percent, S=0.05, and PD is calculated as:

$$PD=(L'+G)\times(5/(100-5))=(L'+G)\times 0.053.$$

For this example, an initial depth PD of the grinding post 420 of about 0.06×(L'+G) is adequate to assure that the post-sintering grinding post depth PD' is sufficient to allow the required post-sintering, post-grinding modified cavity length L3" to be produced.

As discussed above, the original modified cavity length L3 is chosen to be substantially equal to the sum of the length L' of the sintered inner core body 300' and the gap distance G (e.g., L3=L'+G); and the original depth PD of the grinding post 420 is selected to be at least as great as the maximum expected shrinkage of the modified cavity length. Accordingly, if no shrinkage of the green outer core 410 occurs during the sintering process, the sintered modified cavity length L3' is equal to L'+G, and no grinding of the sintered grinding post 420' is required. If shrinkage up to the maximum expected shrinkage occurs, the depth PD' of the sintered grinding post can be ground to reduce the depth PD' to the depth PD" as needed to adjust the sintered modified cavity length L3' until the ground modified cavity length L3" is equal to L'+G.

It should be appreciated that grinding the relatively small surface of the sintered grinding post 420' is much simpler than grinding the larger inner surface 372'. For example, the surface of the sintered grinding post may be ground with a smaller grinding tool and may be ground with fewer passes of the grinding tool.

Figure 13:
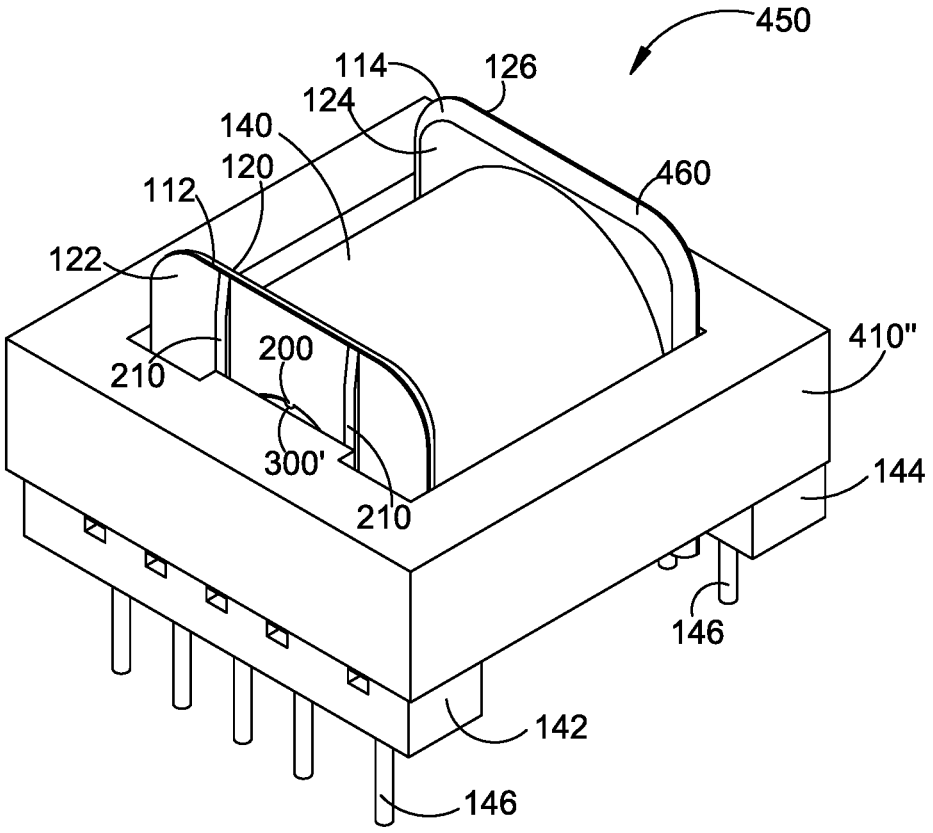
FIG. 13 illustrates the sintered and ground outer core body of FIG. 11 and the sintered inner core body of FIG. 8 installed on the bobbin of FIGS. 1-6.

As illustrated for a magnetic assembly 450 in FIG. 13, the sintered and ground outer core body 410" of FIGS. 9-12 is positioned over the outer ribs 210 of a bobbin 460. The bobbin 460 in FIG. 13 is similar to the bobbin 110 of FIGS. 1-6 except that the outer ribs 210 of the bobbin 460 are positioned closer to the inner passageway 130 (see FIG. 2) so that the ribs engage the narrower width of the grinding post 420". The outer ribs center the face 422" of the grinding post and the second inner face 372' of the cavity 350' of the outer core body with respect to the first end surface 340' and the second end surface 342' of the sintered inner core 300' to cause the gaps between the respective surfaces to be approximately equal.

Figure 14:
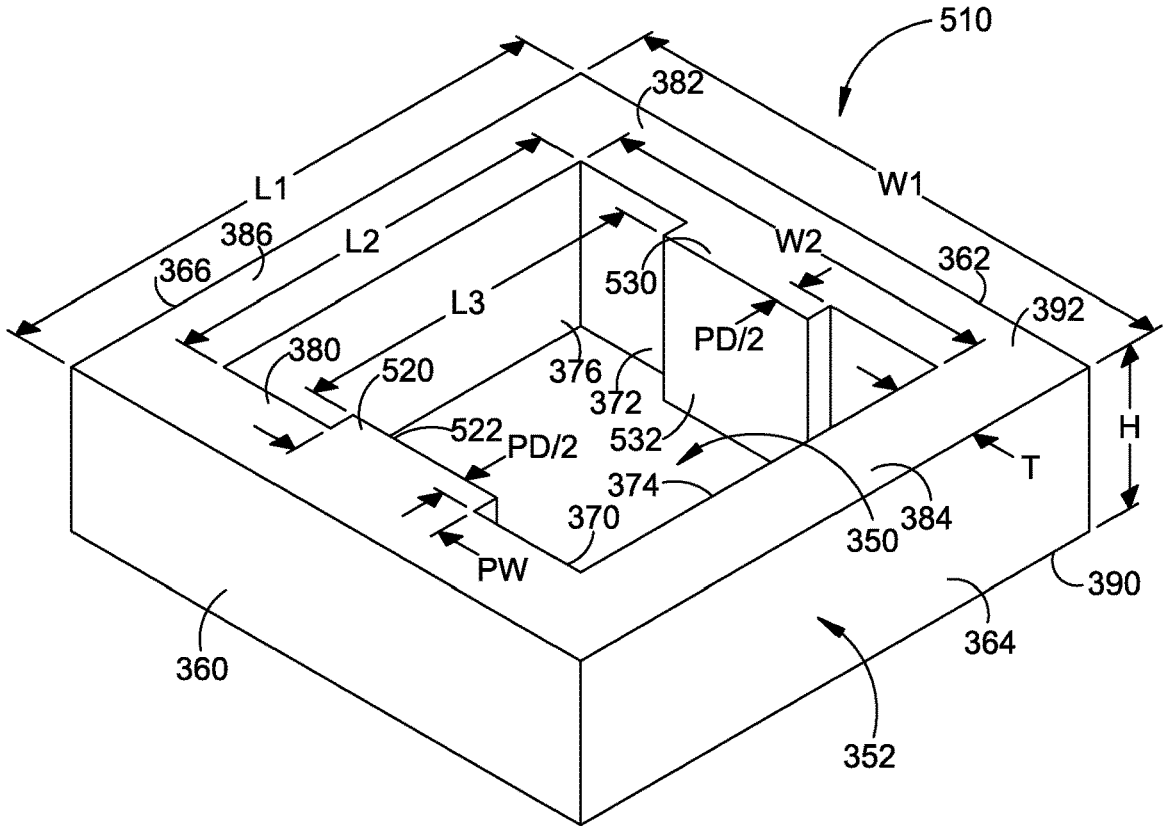
FIG. 14 illustrates a further improved outer core body similar to the outer core body of FIG. 9 but with a second protrusion (grinding post), wherein the outer core body of FIG. 14 is shown prior to a sintering process.

FIG. 14 illustrates an alternative embodiment of an outer core body 510, which is similar to the outer core body 410 of FIGS. 9-12 except that the outer core body 510 includes a first grinding post 520 with a first grinding post face 522 and a second grinding post 530 with a second grinding post face 532. The other elements of the outer core body 510 correspond to the elements of the outer core body 410 and are numbered accordingly.

Figure 15:
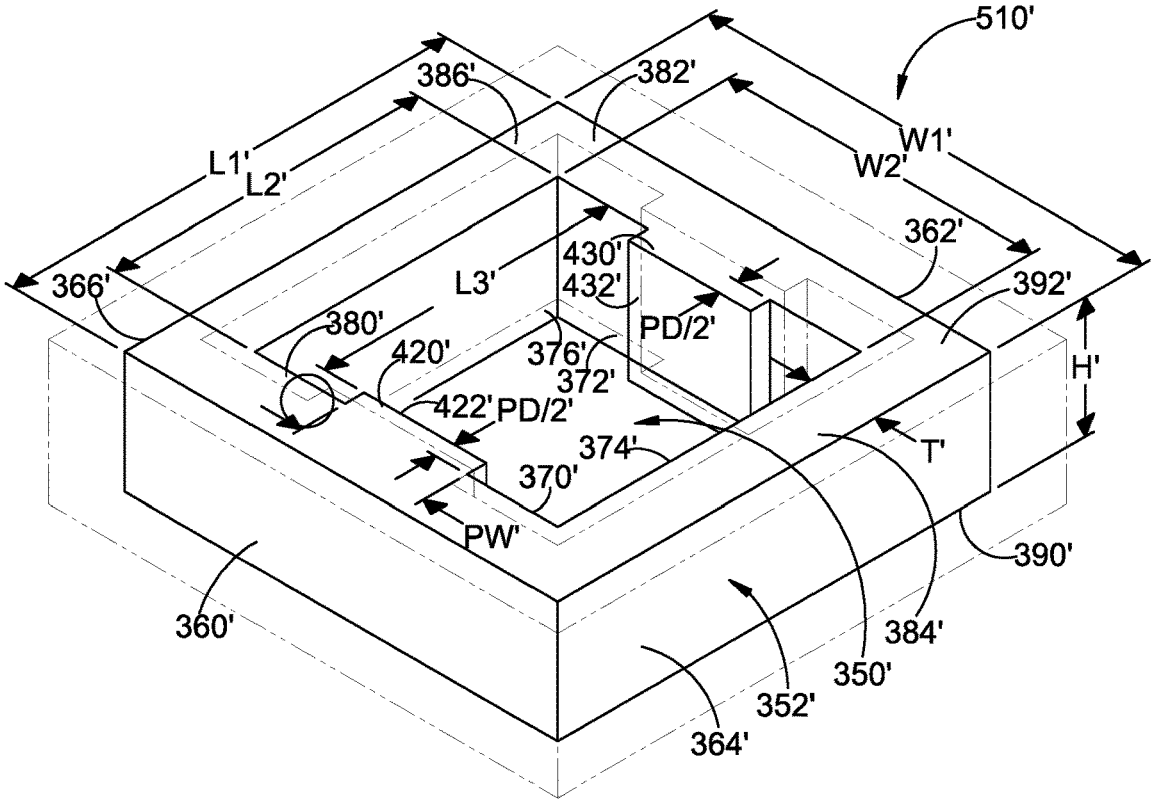
FIG. 15 illustrates the effect of a sintering process on the outer core body of FIG. 14, wherein the pre-sintering outer core body of FIG. 14 is shown in phantom lines and the smaller post-sintering outer core body is shown in solid lines.
Figure 16:
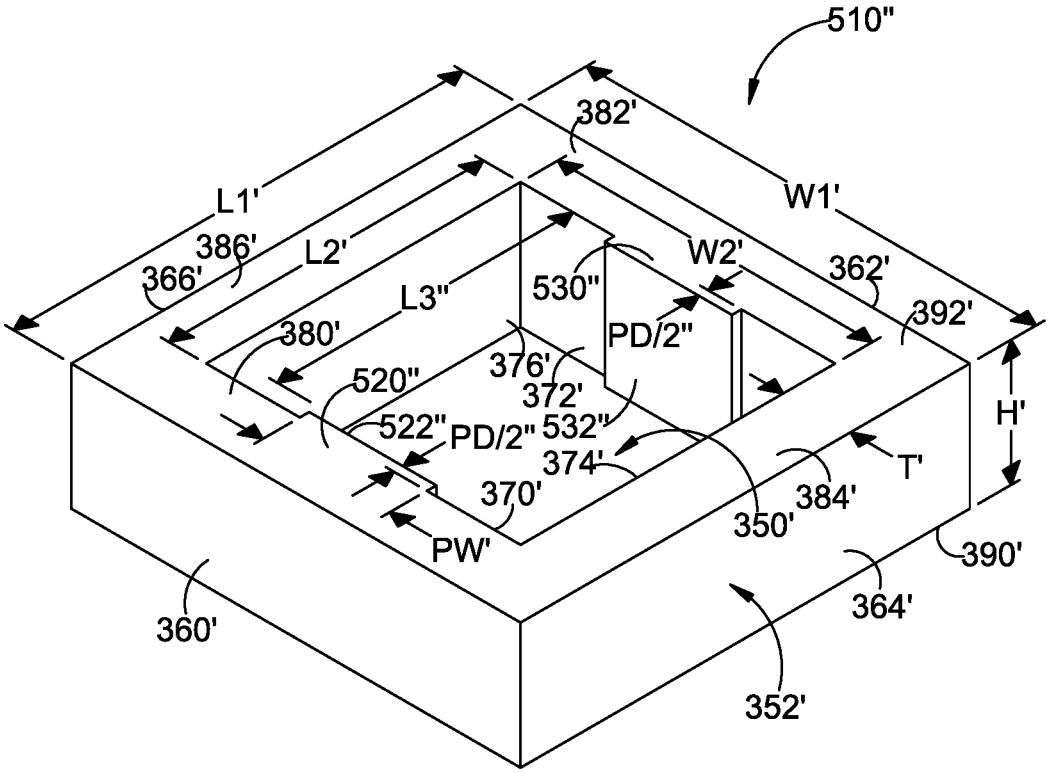
FIG. 16 illustrates the post-sintering outer core body of FIG. 15 following the grinding of the two protrusions to adjust the modified cavity length.

FIG. 15 illustrates the effect of a sintering process on the outer core body of FIG. 14, wherein the pre-sintering outer core body of FIG. 14 is shown in phantom lines and the smaller post-sintering outer core body is shown in solid lines. FIG. 16 illustrates the post-sintering outer core body of FIG. 15 following the grinding of the two protrusions to adjust the modified cavity length.

The first grinding post 520 in FIG. 14 extends from the first inner face 370 of the cavity 350 as before. The second grinding post 530 extends from the second inner face 372 of the cavity. The two grinding posts of FIG. 14 provide a benefit similar to the single grinding post 420 of FIGS. 9-12; however, in the embodiment of FIG. 14, each grinding post only extends by approximately half the distance from the respective inner surface in comparison to the single grinding post. For example, if the maximum expected shrinkage is 15 percent (0.15 decimal) and the single grinding post of FIGS. 9-12 has a depth PD of approximately 0.18 times L'+G (e.g., PD=(0.18×(L'+G)) as discussed above, each of the two grinding posts of FIG. 14 can have a respective depth PD1 and PD2, which are each approximately half the depth PD of the single grinding post (e.g., PD1=PD2=PD/2, where PD/2=0.09 (L'+G)). If shrinkage occurs and grinding is needed after the sintering process, approximately the same amount of material can be removed from each of the two grinding posts so that the final modified cavity length L3" is equal to the desired length (e.g., L3"=L'+G). By removing approximately the same amount from each grinding post, the final outer body created from this embodiment can be centered on the bobbin 460 of FIG. 13.

Although there have been described particular embodiments of the present invention of a new and useful "Magnetic Core Structure and Manufacturing Method Using a Grinding Post," it is not intended that such references be construed as limitations upon the scope of this invention except as set forth in the following claims.

What is claimed is:

1. A method for assembling a magnetic assembly, comprising:

providing a bobbin having a first end flange and a second end flange, the bobbin having a passageway between the first end flange and the second end flange, the passageway having a passageway length from the first end flange to the second end flange;

inserting an inner core into the passageway of the bobbin, the inner core having a length such that a first end surface of the inner core is proximate to the first end flange of the bobbin and a second end surface of the inner core is proximate to the second end flange of the bobbin, the inner core having an inner core length from the first end surface to the second end surface;

forming an outer core having an outer wall surrounding an inner cavity, the inner cavity having at least a first inner surface and a second inner surface, the second inner surface parallel to the first inner surface, at least the first inner surface having a first protrusion extending into the inner cavity toward the second inner surface, the first protrusion having a first protrusion face, the first protrusion face initially spaced apart from a portion of the second inner surface by an initial modifiable inner cavity distance;

removing a portion of the first protrusion at the first protrusion face to increase the initial modifiable inner cavity distance to a modified inner cavity distance selected to be greater than the inner core length by a total gap distance; and positioning the outer core onto the bobbin with the first protrusion face proximate to the first end surface of the inner core and with the portion of the second inner surface proximate to the second end surface of the inner core.

2. The method as defined in claim 1, wherein the first protrusion face is spaced apart from the first end surface of the inner core by a first gap distance and the portion of the second inner surface is spaced apart from the second end surface of the inner core by a second gap distance, the second gap distance and the first gap distance being substantially equal.

3. The method as defined in claim 1, wherein the portion of the second inner surface of the cavity further includes a second protrusion extending into the cavity toward the first protrusion face, the second protrusion having a second protrusion face, the method further comprising removing a portion of the second protrusion at the second protrusion face to increase the modifiable inner cavity distance.

4. The method as defined in claim 3, wherein the first protrusion face is spaced apart from the first end surface of the inner core by a first gap distance and the second protrusion face is spaced apart from the second end surface of the inner core by a second gap distance, the second gap distance and the first gap distance being substantially equal.

5. The method as defined in claim 1, wherein the outer core is formed by a sintering process, and wherein the first protrusion extends from the first inner surface by a pre-sintering grinding post length, the pre-sintering grinding post length selected to be at least as long as the product of an expected sintering shrinkage factor F times a sum of the inner core length and the total gap distance, the expected sintering shrinkage factor F determined by a maximum expected sintering shrinkage percentage S during the sintering process, wherein $F=S/(100-S)$.

* * * * *